United States Patent [19]

Drago et al.

[11] 4,042,989

[45] Aug. 23, 1977

[54] METHOD FOR PACKAGING AND DYEING YARNS AND YARN PACKAGING OBTAINED THEREBY

[75] Inventors: Leo Drago, Schio, Italy; Edmond Ries, Luxembourg, Luxembourg

[73] Assignee: Robreli Holding S.A., Germany

[21] Appl. No.: 675,126

[22] Filed: Apr. 8, 1976

[30] Foreign Application Priority Data

Apr. 8, 1975 Italy ..... 22125/75

[51] Int. Cl.[2] ..... D06B 1/02; D06B 23/04; B65H 51/20

[52] U.S. Cl. ..... 8/149; 8/151.2; 28/290; 68/205 E; 68/212; 242/47.12

[58] Field of Search ..... 8/149, 151.1, 151.2, 8/155, 148; 68/205 E, 205 R, 13 R, 198, 212; 242/47.12, 47.13; 28/1 CL, 72.16

[56] References Cited

U.S. PATENT DOCUMENTS

| | | | |
|---|---|---|---|
| 1,851,252 | 3/1932 | Junkers | 242/47.13 |
| 2,317,747 | 4/1943 | Ewing | 68/205 E X |
| 3,644,969 | 2/1972 | Guillermin et al. | 8/148 X |
| 3,650,674 | 3/1972 | Newton | 8/155 X |
| 3,749,327 | 7/1973 | Roethke et al. | 242/47.12 |
| 3,808,618 | 5/1974 | Arimoto et al. | 8/151.2 X |
| 3,930,357 | 1/1976 | Gibson | 28/72.16 X |

*Primary Examiner*—Philip R. Coe
*Attorney, Agent, or Firm*—Diller, Brown, Ramik & Wight

[57] ABSTRACT

Method for packaging and dyeing yarns comprising the steps of winding at least one yarn on a provisional core, at the same time imparting to the yarn a continuous rotation and a rciprocating translation, and to advance the wound yarn continuously so that it comes off the said core. The tubular packaging that continuously comes off its support core has brought to bear on it a plurality of jets or sprays of dye directed radially, over the entire circumference of the packaging.

8 Claims, 6 Drawing Figures

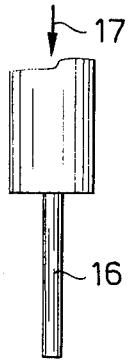
Fig. 4
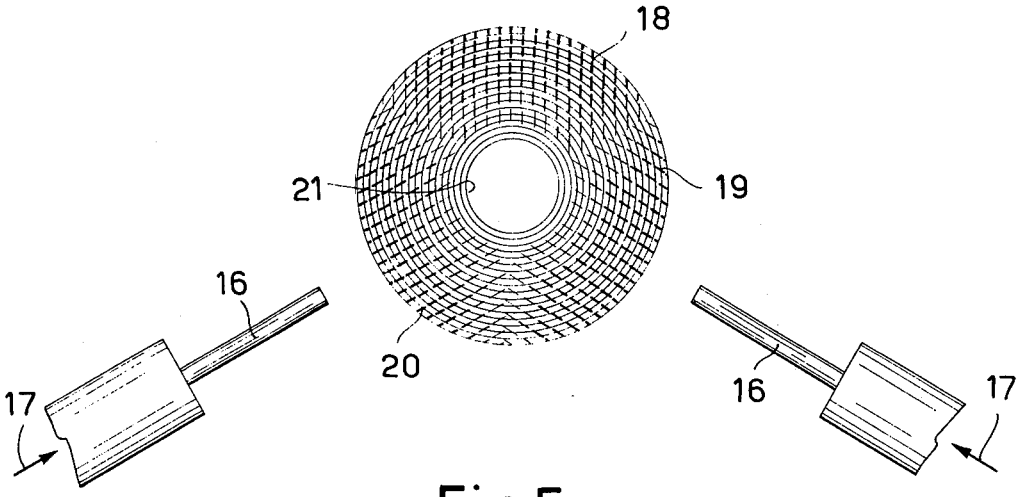
Fig. 5
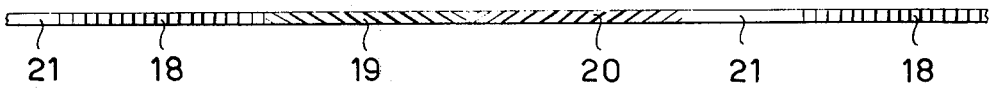

METHOD FOR PACKAGING AND DYEING YARNS AND YARN PACKAGING OBTAINED THEREBY

The present invention concerns a method for packaging yarns that are required to undergo treatments such as shrinking and dyeing.

The invention also concerns a method for the continuous dyeing in several colours and in non-uniform manner of a yarn, and the dyed yarn obtained according to such method.

As is well-known to person skilled in the art, before undergoing shrinking and dyeing treatments a yarn is packaged up into packagings such as allow the said processes to be performed in a convenient manner and with satisfactory results.

One type of traditional packaging is the skein, in which the yarn is wound off from spinning bobbins and, by means of reeling frames, is packaged up into skeins.

Originally, the skeins weighed 100 grams each: thereafter, a change was made to skeins of 200 - 400 - 500 grams each and at the present time, with certain types of yarn suitable for carpets - and therefore very large - there are "Jumbo" skeins of 5 kg. each. For normal knitting-machine yarns, however, the accepted weight varies between 1 and 2 kg.

After they have been reeled, the skeins are loaded onto dyeing sticks. At this point, two possibilities exist:

- the shrinking can be performed with steam autoclave, or
- the shrinking can be performed directly in the dyeing apparatus.

If the shrinking is performed in steam autoclave, the skeins loaded onto dyeing sticks, which are held firm in special trolleys, are treated in he autoclave.

After this treatment the sticks supporting the skeins are placed into the dyeing apparatuses and the material is dyed in the normal way.

If, however, the shrinking is performed in the dyeing apparatus, the sticks supporting the raw skeins are placed into the dyeing apparatus and the material is shrunk with the dyeing bath itself and then dyed normally.

After dyeing, the skeins have to be removed from the sticks and placed into a centrifuge for centrifugation.

After centrifugation, the skeins are dried and then have to be re-placed onto the sticks or on suitable supports in order to be able to proceed to the drying.

When they leave the dryer, the skeins are packed for shipment. Subsequently, the skeins have to be wound off and thus transformed into reels, to enable them to proceed to the weaving or knitting steps or to other processings.

A recent technique in the processing of the skeins is represented by dyeing baths with unified stick length, to allow use of a dryer in which centrifugation is obviated inasmuch as the said skeins, without having to be removed from dyeing sticks, are pressed by special devices and then dried, without intermediate manipulation.

It is easy to appreciate that, during all these processing steps, the skeins, having to be manipulated several times, may become disarranged and therefore complicate their subsequent winding off.

It has, on the other hand, to be borne in mind that skein-dyed yarn is very bulky and soft to the touch. It is possible to achieve these results by reason of the fact that the density of the skeins loaded into the dyeing apparatuses is very low.

Much research has been carried out by all constructors in the field in an attempt to find an alternative to skein-dyeing. The lines of research are two in number, and more exactly:

- the dyeing of packagings made with already shrunk yarn,
- the dyeing of packagings made with raw yarn, such packagings allowing simultaneous shrinking and dyeing.

In the first case the packagings to be dyed are of the so-called "bun" type, i.e. cylindrical criss-crossed reels without any internal right tube and with an outer protective stocking.

The yarns with which the said "buns" are wound comes from a continuous shrinking machine. This system makes it possible to achieve dyeing results that are good as far as uniformity is concerned, but, apart from the low output of the continuous shrinking machines, and their high cost, the said system yields a yarn that is not very bulky and which is also somewhat flattened, in that the density of the "buns" is distinctly higher than that of the skeins. The touch, or hand, is moreover rougher, and therefore not accepted unanimously.

It should also be borne in mind that, with this system of continuous shrnking, the shrinking is never total, there remaining on the yarn a residual shrinking which evolves during the dyeing step, giving rise to possible irregular flattenings of the yarn, as mentioned previously.

The other system, which employs packagings made with raw yarn, i.e. non-shrunk yarn, and which allows simultaneous shrinking and dyeing, appears to be more successful. Such packagings in fact posses dimensions and particularities of winding such as allow to shrink on themselves, encouraging the swelling of the yarn and maintaining an acceptable density.

The advantage of he said packagings is, also, that they are heavier as compared with the normal "buns", and thyus the subsequent processing steps are on the whole less burdensome.

The general purpose of the present invention is to realize a method of packaging of yarns by means of which there can be obtained a yarn packaging with the advantages of the traditional packagings but without their defects.

More exactly, one purpose of the present invention is to realize a method of packaging a yarn due to undergo treatments such as shrinking and dyeing, by means of which method there can be obtained a yarn packing having very low density per unit of volume and, more importantly, a density that is uniform throughout the material.

Another purpose of the present invention is to realize a yarn packing capable both of being further packaged in the form of a "bun" and of undergoing directly a treatment of shrinking and dyeing, taking the yarn straight off from the packaging itself.

In view of the aforesaid purposes, the invention aims to realize a method characterized in that it comprises the following steps : of winding at least one yarn on a provisional core, at the same time imparting to the yarn a continuous rotation and a reciprocating translation, and to advance the wound yarn continuously so that it comes off the said core.

In this way there is obtained a yarn packaging in the form of a continuous tube, which can be utilized in various ways.

The tubular packaging that comes off its support core can be passed directly through a shrinking tunnel using vapourization or hot air, can then be stopped at any desired length and packaged in the form of a "bun" in order to be subjected to dyeing.

Alternatively, the tubular packaging, being flexible, can be directly packaged in the form of a "bun", which is subsequently given shrinking and dyeing treatments in the traditional manner.

As a further alternative, the yarn can be wound straight off the tubular packaging and sent to dyeing.

According to the present invention, the tubular yarn packaging that is wound off its support core can also be directly subjected, in advantageous manner, to a continuous dyeing treatment to obtain a yarn dyed non-uniformly in several colours.

At the present time, various methods are known for the continuous dyeing of a yarn non-uniformly in several colours. The most widely used methods employ a plurality of pairs of yarn printing cylinders, in cascade arrangement, each of which is pre-set to dye a different area of the said yarn. These methods of printing and their related apparatuses are wel known to persons skilled in this particular art, and thus will not here be described in greater detail.

To the printing cylinders are fed either a plurality of parallel filaments wound off from up-stream bobbins, or so-called "yarn socks", which are districated after dyeing, i.e. staple yarn.

Although they give satisfactory results, these systems of dyeing are economically burdensome, requiring as they do the use of costly and bulky equipment and skilled labour.

Another purpose of the present invention is to realize a method of continuous dyeing in several colours, in nonuniform manner, of a yarn, such as is much more economical than the traditional systems, at the same time giving optimal results.

This pupose is achieved by using the method of packaging and the yarn-packaging described above.

According to a further characteristic of the present invention, the tubular packaging that continuously comes off its support core has brought to bear on it a plurality of jets or sprays of dye directed radially, over the entire circumference of the packaging.

To this end, provision is made for a plurality of spraing devices, each of which applies a different dye onto a precise sector of the packaging. This latter, if cross sectioned, will thus present circumferential sectors dyed with different colours. The packaging dyed in this way is then given a vapourization treatment, for example in an apparatus such as that described in the Italian patent application N° 26675 A/75 of Aug. 28, 1975. After being vapourized, the packaging is run out and appears with alternate sections of non-uniform length dyed in the different colours sprayed in the manner described above.

The characteristics of the method according to the invention will be even more clearly understood from the following exemplifying description, referred to the annexed schematic drawings in which:

FIG. 4 is a section according to the line IV—IV of FIG. 1;

FIG. 5 is a detail of the dyed yarn; and

Figures 1, 2:
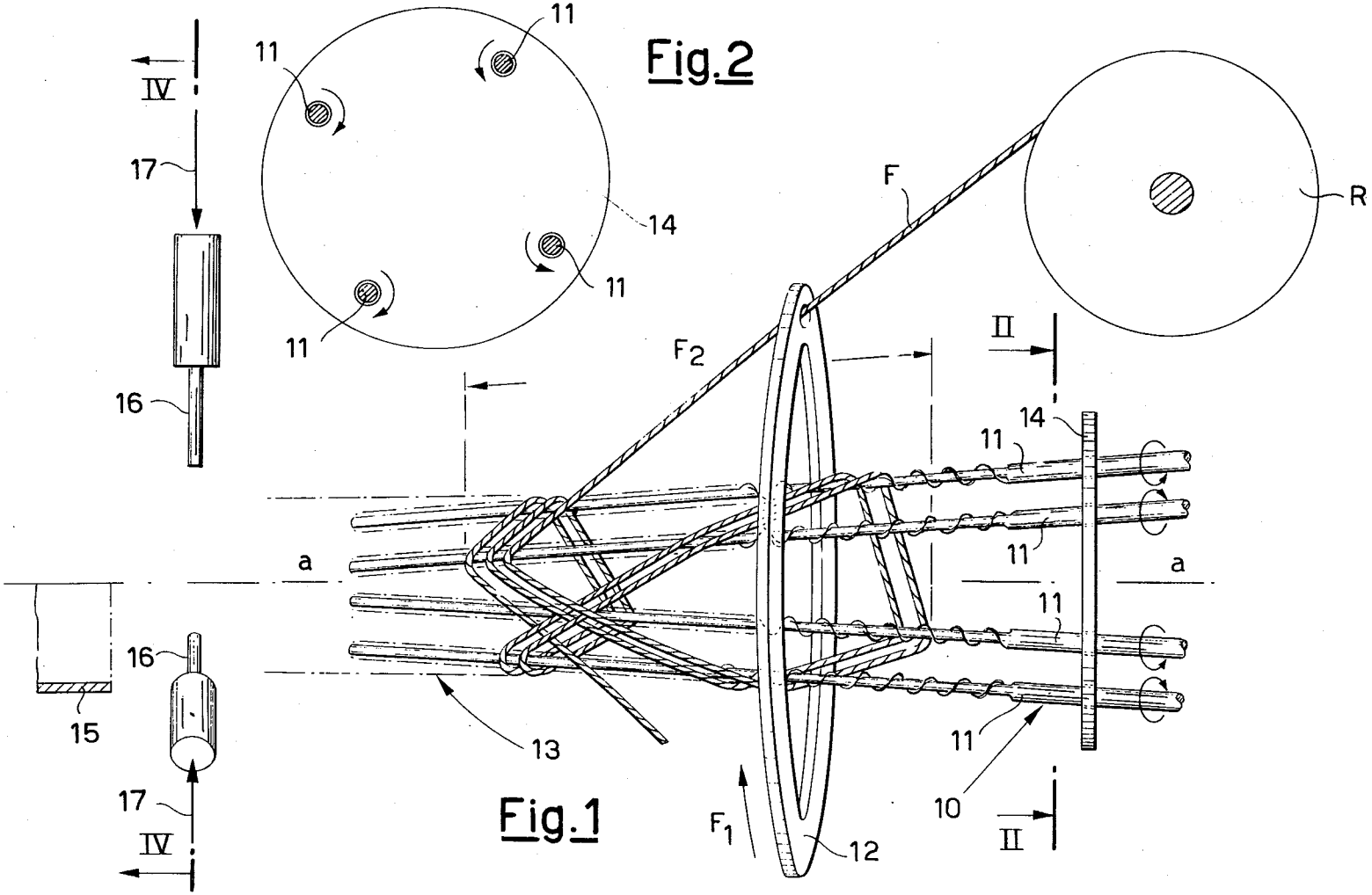
FIG. 1 shows schematically in longitudinal view how the method according to the invention is put into practice.
FIG. 2 is a section according to the line II—II of FIG. 1.
Figure 3:
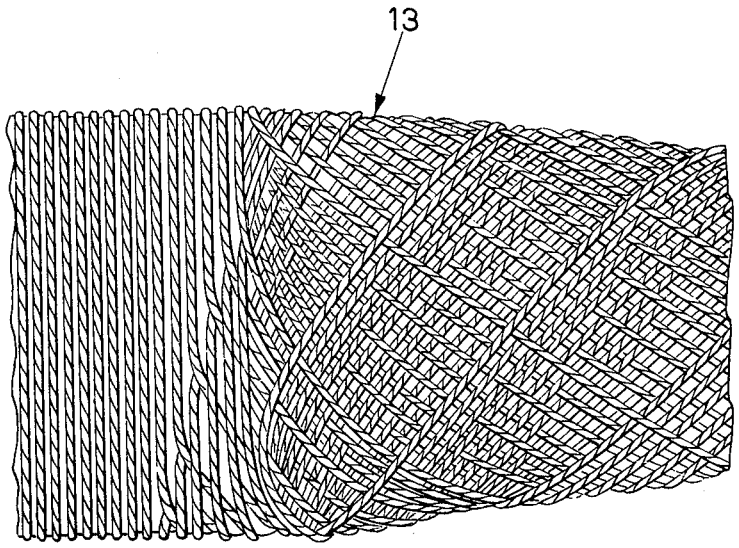
FIG. 3 is a view illustrating a section of a nondyed packaging obtained according to the invention.

In the FIG. 1 of the drawing there is illustrated a yarn F which is wound off one or more bobbins R, simultaneously, and wound onto a provisional support core schematically shown at 10.

The packaging can in fact also be made with several single filaments fed together, since at the unwinding stage the filaments come out perfectly parallel each other.

In the Example shown, the support, or core, 10, is in the form of four screws 11 of relatively large pitch, arranged in he convergent manner illustrated in FIG. 1 on generating lines of a cone. The screws 11 are caused to rotate in the directions indicated by the arrows in FIG. 2 by means of motor means of traditional type, which are herefore not shown. A support for the said screws is shown schematically at 14.

The yarn F is wound around the screws 11 by means of a thread-guide shown schematically at 12, which has a continuous rotation movement in the direction of the arrow $F_1$ and a reciprocating translation movement in the direections of the arrow $F_2$. This continuous movement of the thread-guide takes place coaxially to the axis *a—a*, and can be controlled by traditional motor means of anky type suitable for the purpose, and thus not shown in detail.

The yarn F is thus wound onto the core 10 with a ceoaaws-thread arrangement as shown in FIG. 1. The wound threads are adjacent to each other, although the stroke of the thread-guide 11 is always equal, as a result of the continuous and uniform feed that the rotating screws 11 impart to the spirals of yarn wound onto them.

It becomes clear that the tube of yarn 13 which forms on the core 10 is consequently wound off the screws 11 by the rotation of the said screws and by the thrust that the back-lying spirals of yarn that are fed onto the screws exerts on the tube of yarn in front of them. Clearly, the flexible tubular packaging that comes off the core 10 and which advances continuously in the aforesaid manner is positively supported, for example by means of a channel 15.

It should be specified that the method according to the invention can be put into practice with means of any kind, even means different from those schematicaly illustrated in the drawings, provided they are capable of winding the yarn in the manner described above.

Furthermore, depending on requirements, the pitch of the spirals of yarn can be varied, for example by altering the length of the stroke of the thread-guide.

The yarn packaging (tubular) obtained has a very low yarn density and consequently, for the reasons stated heretofore, lends itself to undergoing in advantageous manner treatments of shrinking and dyeing, giving a yarn that is bulky and soft to the touch.

If it is wished to obtain a yarn dyed in several colours, in non-uniform manner, according to a further characteristic of the method of the invention, provision is made, around the tubular packaging 13, for a plurality of stationary spraying nozzles 16 which are fed, through respective lines 17, with liquid dyes of different colour.

In the example shown, three spraying nozzles 16 are illustrated, each of which is suited to spray a different dye onto a pre-determined area of the continuously advancing tubular packaging.

Practical tests have demonstrated that each due sprayed penetrates the spirals of yarn in radial directions, so as to affect a sector which extends from the outer surface almost to the centre of the tubular packaging.

The FIG. 4 shows schematically the cross section of a tubular packaging of yarn dyed with the method according to the invention wherein 18, 19, 20 indicate respectively the circumferential sectors dyed with different colours, while 21 indicates the central zone of the packaging, more or less ample, which can remain the same colour as the starting yarn. Between one sector and another there can also remain non-dyed spaces, where the yarn is consequently of the original colour.

Figure 6:
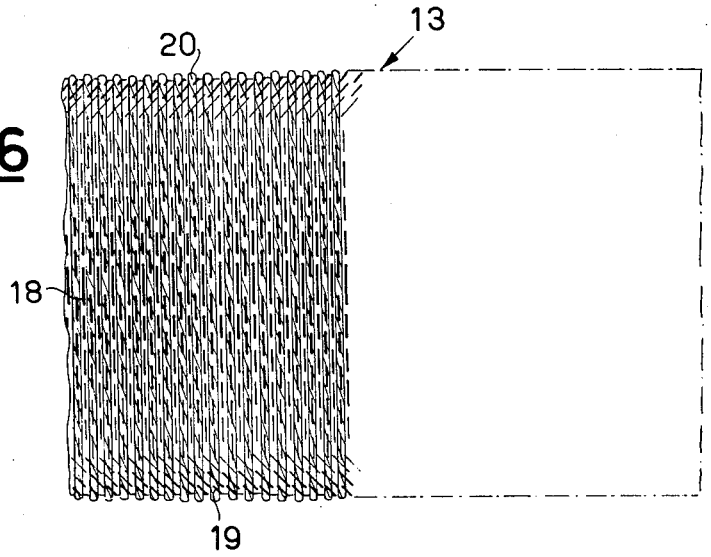
FIG. 6 shows a section of dyed packaging.

The tubular packaging dyed in this way (FIG. 6) is then sent directly to a vaporization treatment. After vapourization, the yarn can be wound straight off from the packaging and appears as shown in FIG. 5, i.e. with alternate sections of different length and colour.

Persons skilled in the art will see the extreme simplicity and economical nature of the method according to the invention, which thus achieves the purpose mentioned in the first part of the specification.

What is claimed:

1. A method for packaging yarns, said method comprising the steps of providing a provisional core having an axis, winding at last one yarn onto said provisional core while simultaneously imparting to said yarn a continuous combined rotational movement about said provisional core and reciprocating movement longitudinally of said core axis, and continuously advancing the wound yarn along said core so that said yarn moves longitudinally of said core axis and comes off the end of said core remote from where said winding is effected.

2. A packaging of yarn obtained with the method according to claim 1, characterized in that the packaging of yarn has substantially tubular form and is flexible.

3. A method of packaging in accordance with claim 1 together with the movement of the wound yarn along the core to form a continuously advancing tubular packaging, and thereafter continuously dyeing with several colours and in a non-uniform manner the continuously advancing tubular packaging by bringing to bear on the tubular packaging a plurality of jets or sprays of different dyes.

4. A method according to claim 3 characterized in that said sprays are directed radially toward the core axis.

5. A method according to claim 3, characterized in that said sprays cover the entire circumference of the tubular packaging.

6. A method of packaging in accordance with claim 1 wherein the core is in the form of a plurality of longitudinally extending screws, and said continuous advancing of the wound yarn on the core is effected by the rotation of the screws.

7. A method of packaging in accordance with claim 6 wherein removal of the wound yarn from the core is facilitated by arranging the screws in a generally conical pattern.

8. The method of claim 6 wherein the screws are held fast longitudinally of the core axis.

* * * * *